United States Patent [19]

Renzulli et al.

[11] Patent Number: 4,877,410

[45] Date of Patent: Oct. 31, 1989

[54] PROCESS FOR TANNING FISH SKIN

[75] Inventors: Francesco Renzulli; Antonio Del Gaudio; Piero Renzulli, all of Napoli, Italy

[73] Assignee: CO.GE.IT. S.R.L. - Costruzioni Generali Italiane, Napoli, Italy

[21] Appl. No.: 19,014

[22] Filed: Feb. 26, 1987

[30] Foreign Application Priority Data

Mar. 7, 1986 [IT] Italy ..... 47736 A/86

[51] Int. Cl.[4] ..... C14C 3/00

[52] U.S. Cl. ..... 8/94.12; 8/74.19 R

[58] Field of Search ..... 8/94.12, 94.13, 94.19

[56] References Cited

U.S. PATENT DOCUMENTS 2,633,730 4/1953 Rose ..... 8/94.12

*Primary Examiner*—Paul Lieberman
*Assistant Examiner*—John F. McNally
*Attorney, Agent, or Firm*—Brumbaugh, Graves, Donohue & Raymond

[57] ABSTRACT

Fish skins are successively treated in a rotatable apparatus with cold salt water, a distinfectant, an emulsifying agent, salt water, formic acid and chromium and then allowed to dry to produce tanned skins. The tanned skins may further be retanned and dyed.

24 Claims, No Drawings

PROCESS FOR TANNING FISH SKIN

DISCLOSURE OF THE INVENTION

The present invention relates to a process for tanning fish skin. More particularly, the present invention relates to a process which allows tanned fish skin to be obtained having optimal characteristics as regards workability and finishing so that finished products can be made from the same which are perfect from a commercial standpoint.

It is well known that the trade of skin articles such as shoes, bags, wallets and the like is ever increasing and is addressing to a definitely large and industrial market.

Various different types of animal skins are tanned at the present time on an industrial scale, such as for instance skins of lizards, crocodiles, and a lot of others. The major problems that cause the production costs to increase and accordingly which cause the retail prices to increase also, consist more particularly in difficulties involved in the obtainment of raw material.

Moreover, in a number of cases the industrial effort tries to find out new kinds of proposals for customers so as to succeed in acquiring additional market possibilities. As regards this attitude, the competition is increasingly keen and the articles available at the present time do not give many possibilities of changing the production.

It is quite clear from the above that it is very important to have at one's disposal a process for tanning fish skin like that according to the present invention, which allows a skin to be exploited as raw material which is available at definitely lower prices with respect to the skins employed at the present time, such as for instance lizard, reptiles or crocodile skins.

In addition, the process according to the present invention allows the skin to be exploited of animals caught for food purposes, so as to avoid killing animals to the only aim of obtaining their skins.

Moreover, tanned fish skin is characterized by typical ornamental motifs which, being new with respect to the motifs of the skins processed at the present time can be advantageously exploited for advertisement purposes.

Accordingly, it is an object of the present invention that of supplying a fundamental technical teaching for the realization of a process for tanning skin of fish of any kind, and in particular of fish typical of northern seas because of their strength.

Skin tanned with the process of the present invention can be both the fresh type and of the type preserved in the wet state and pickled.

Accordingly, it a specific object of the present invention a process for tanning fish skin, said process comprising the steps of:

(a) introducing into the drum-tumbler or any other similar apparatus for the processing of skins, cold water in weight amounts variable between 1 time and 8 times the weight amount of the skins to be processed and an amount of salt variable in weight between 2% and 30% of the weight of said skins;

(b) causing the drum-tumbler to rotate for a time period variable between 2 and 45 minutes;

(c) introducing the skins into the drum-tumbler and causing the drum to rotate for a period variable between 5 minutes and 1 hour;

(d) introducing into the drum-tumbler an amount variable between 1% and 10% by weight of the skins to be processed of a disinfectant having preservation properties with respect to said skins and which is compatible with the same, and causing the drum-tumbler to rotate for a period variable between 5 minutes and one hour;

(e) introducing into the drum-tumbler an emulsifying agent in amounts between 0.3 an 5% by weight of the skins to be processed, and causing said drum to rotate for a period variable between 5 minutes and 1 hour;

(f) unloading the whole mass from the drum-tumbler;

(g) subjecting the skins so treated to an internal cleaning action so as to remove the flesh residues attached to the same;

(h) weighing the skins so obtained;

(i) introducing the skins into the drum-tumbler together with an amount of water between 0.5 and 6 times the weight amount of the skins according to the step (h) and with an amount of salt such as to obtain a degree Baumé ($B^E$) of about 6.5;

(l) putting the drum-tumbler into rotation for a period variable between 2 and 30 minutes;

(m) introducing formic acid progressively till a pH value is obtained between 3 and 4, and causing the drum to rotate further for a period between 10 minutes and 1 hour;

(n) introducing into the drum-tumbler while it is at a standstill an amount of chromium between 3 and 30% by weight of the skins according to the step (h);

(o) putting the drum-tumbler into rotation for a period variable between 1 hour and 20 hours;

(p) keeping the whole mass at rest about overnight;

(q) washing with running water; and (r) arranging the skins so tanned on a beam at rest or on any other similar device for at least 36 hours.

Thus an optimal product has been obtained which is very suitable for being subjected to the usual retanning treatments in the expected periods.

Preferably according to the present invention after step (p) a further rotation can be carried out for a period of about 30 minutes.

Again according to the present invention, said step (a) is performed with a water amount at a temperature lower than 10° C. which is four times as large as the weight of the skins to be processed, whereas the amount of salt employed in said step is preferably 10% by weight of said skins.

The rotation time of the step (b) is preferably, in the process according to the present invention, of 10 minutes, whereas the rotation of the drum-tumbler according to the step (c) of the same process is carried out preferably for 15 minutes.

Further according to the present invention, the disinfectant introduced into the drum-tumbler according to step (d) is about 3.5% by weight of the skins and the drum-tumbler is caused to rotate preferably for a period of 15 minutes.

More particularly, said disinfectant can be the same as that commercially available under the names of SOLANA S or IMEROLO SJ.

In addition, the emulsifying agent introduced according to the step (e) is supplied in amounts of 1% by weight of the skins to be processed and the drum-tumbler is made to rotate preferably for a time of 15 minutes in order to complete step (e).

Again according to the present invention, the cleaning action performed on the skins so treated and unloaded after step (g) can be carried out by fleshing, by hanging on nails and by shaving or pressing and shaving.

Step (i) of the process according to the present invention can be performed advantageously with water at a temperature lower than 10° C. and in amounts of 2.5 times the weight amount of the skins according to step h) and with an amount of salt of 15% by weight of the skins.

Moreover, said step (1) in which the drum-tumbler is made to rotate can be performed for a period of 10 minutes.

The progressive introduction of formic acid can be carried out according to the present invention till a pH value is obtained of 3.5 and step (m) can comprise preferably a 30 minutes rotation.

Further according to the present invention, chromium introduced in step (n) can be of the self-alkalinizing type (for instance, the product commercially available under the name of BAICROM F) in amounts of 15% by weight of the skins according to step h).

In addition, the rotation of step (o) can occur for a period of 8 hours.

The rest period of the skins tanned by means of the process according to the present invention can be preferably of 48 hours.

With the process according to the present invention, tanned fish skins are obtained which are ready for being subjected to retanning and dyeing treatments.

More particularly, a process is suggested according to the present invention of retanning and dyeing of fish skins obtained through the process of the present invention, by which retanning and dyeing procedure a finished product can be obtained that is ready for the refinish procedure and has optimal features, considering that it is possible to treat the products obtained through said procedure by means of the usual retanning and dyeing treatments so as to obtain equally good quality skins that are ready for the refinish treatment.

Moreover, it is also an object of the present invention a retanning treatment of fish skins obtained through the procedure disclosed above, which treatment comprises the step of:

(1) blubbering the skins in water at a temperature between 20° C. and 50° C. in amounts of 0.5–8 times as large as the weight of the skins according to step (h) of the process, with a blubbering agent in amounts between 0.5 and 10% by weight of skins according to step (h), causing the drum-tumbler to rotate for a period variable between 10 minutes and 2 hours;

(2) unloading the drum-tumbler by taking out the liquid and leaving the skins behind;

(3) introducing into the drum-tumbler a water amount of 0.5–8 times the weight amount of the skins according to step (h), at a temperature between 20° C. and 60° C., and adding an amount between 0.5 and 10% by weight of said skins of a neutralizing agent and making the drum-tumbler to rotate for a time between 5 minutes and 2 hours;

(4) adding an amount of a product of a tanning-base vegetable origin in amounts between 1 and 10% by weight of the skins according to step (h) and causing the drum-tumbler to rotate for a time variable between 10 minutes and 1 hour;

(5) unloading the bath;

(6) washing the skins in running water for a time variable between 5 and 10 minutes and unloading the bath;

(7) padding or stuffing the skins so obtained by introducing a water amount at a temperature between 20° C. and 80° C., said amount being variable between 1.5 and 8 times the weight amount of the skins according to step h), and with an amount variable between 1.5 and 30% of said weight of the skins of a softening agent;

(8) causing the whole mass to rotate for a period between 5 minutes and 2 hours;

(9) carrying out a vegetable retanning by adding an amount variable between 2% and 50% by weight of the skins according to step (h) of the process, of a tannin-base vegetable product and causing the drum-tumbler to rotate for a period variable between 5 minutes and 2 hours.

At that point the skins so obtained are completely finished so that the bath can be unloaded and the dyeing treatment can be performed next or otherwise the dyeing treatment can be carried out in the bath itself without unloading the same.

Preferably, the dyeing process is carried out through the following steps:

(10) adding dyes to the bath;

(11) adding formic acid in amounts variable between 0.5 and 10% by weight of said weight of the skins and causing the drum-tumbler to rotate for a time variable between 10 minutes and 2 hours;

(12) unloading the bath.

Preferably according to the present invention the blubbering of the skins according to the present invention can be performed with water at a temperature of 35° C., water being present in amounts twice as large as said weight, and with an amount of the blubbering agent equal to 2% of that weight, and causing the drum-tumbler to rotate for 40 minutes.

Again according to the present invention, step (3) of the retanning process can be carried out with water at 40° C. in amounts twice as large as the weight of the skins according to step h) and with an amount of the neutralizing agent equal to 2% of the same weight, and causing the drum-tumbler to rotate for 20 minutes.

In addition, the tannin-base product can be added according to step (4) in amounts of 5% by weight and the rotation can be performed for 40 minutes, said product being for instance the TAMOL GA.

Further according to the present invention the padding or stuffing operation of the skin can be carried out within amounts of water at 55° C. three times as large as the weight of the skins as defined above and employing an amount of 8% by weight of the softening agent. Sais softener can be made up of 5% of GLICERMAX 52 and 3% of SERIDOL 82.

The first of said products acts as a softening agent whereas the second one avoids the fact that the so-called "grain" or the top part of the skin itself be affected too much by the action of the first product.

The rotation for realizing the blubbering step may last by preference 30 minutes.

The vegetable retanning according to step (9) can be carried out by adding preferably an amount of the vegetable product equal to 13% of the weight of the skins as defined above and causing the drum-tumbler to rotate for 30 minutes.

More particularly the retanning can be performed by adding 5% by weight of TAMOL GA and 8% by weight of TANIGAN OS.

In the dyeing step formic acid can be preferably added in amounts equal to 2% by weight of the skins according to step (h) causing the drum-tumbler to rotate for about 40 minutes.

At that point the product is completely finished and it is ready for being subjected to the usual refinish operations.

The present invention has been disclosed with a particular reference to some specific embodiments of the same but it is to be understood that modifications and changes can be introduced by those who are skilled in the art without departing from the spirit and scope of the invention for which a priority right is claimed.

I claim:

1. A process for treating fish skins comprising in sequence:

(a) introducing into a rotable apparatus for the processing of skins an amount of cold water which is between 1 time and 8 times the weight of the skins to be processed; and an amount of salt which is between 2% and 30% by weight of the weight of the skins;

(b) rotating the apparatus for a period between 2 and 45 minutes;

(c) introducing fish skins to be processed into the apparatus and rotating the apparatus for a period between 5 minutes and 1 hour;

(d) introducing into the apparatus an amount of disinfectant which is between 1% and 10% by weight of the weight of the skins, such disinfectant being compatible and having preservation properties with respect to the skins; and rotating the apparatus for a period between 5 minutes and 1 hour;

(e) introducing into the apparatus an amount of emulsifying agent which is between 0.3% and 5% by weight of the weight of the skins, and rotating the drum-tumbler for a period between 5 minutes and 1 hour;

(f) removing the entire contents of the apparatus;

(g) removing the flesh residue attached to the skins;

(h) weighing the cleaned skins to obtain a partially processed skin weight;

(i) reintroducing into the apparatus the cleaned skins, an amount of water which is between 0.5 and 6 times the partially processed skin weight and an amount of salt so as to obtain a degree Baume ($B^E$) of approximately 6.5;

(j) rotating the apparatus for a period between 2 and 30 minutes;

(k) introducing into the apparatus formic acid progressively until a pH value between 3 and 4 is obtained, and rotating the apparatus for a period between 10 minutes and 1 hour;

(l) introducing into the apparatus while it is at a standstill, an amount of chromium which is between 3% and 30% by weight of the partially processed skin weight;

(m) rotating the apparatus for a period between 1 hour and 20 hours;

(n) allowing the entire contents of the apparatus to settle for approximately 12 hours;

(o) removing the entire contents of the apparatus;

(p) washing the removed skins with water;

(q) arranging the skins, on a supporting device and allowing them to rest for at least 36 hours, whereby a tanned fish skin is formed.

2. A process according to claim 1, further comprising the step of rotating the apparatus for approximately 30 minutes after step n.

3. A process according to claim 1, wherein step (a) is performed with water at a temperature of 10° C. and in an amount of 4 times the weight of the skins and an amount of salt which is 10% by weight, the weight of the skins.

4. A process according to claim 1, wherein the rotation in step (b) is performed for 10 minutes.

5. A process according to claim 1, wherein the rotation in step (c) is performed for 15 minutes.

6. A process according to claim 1, wherein step (d) is carried out with a disinfectant equal to 3.5% by weight of the weight of the skins and the apparatus is rotated for 15 minutes.

7. A process according to claim 1, wherein step (e) is performed with an emulsifying agent equal to 1% by weight of the weight of the skins, and the apparatus is rotated for 15 minutes.

8. A process according to claim 2, wherein the cleaning action of step (g) is carried out through the operations of fleshing, hanging on nails and shaving, or pressing and shaving.

9. A process according to claim 1, wherein step (i) is carried out by introducing into the apparatus, together with said skins, an amount of water at a temperature lower than 10° C., equal to 2.5 times the partially processed skin weight, and an amount of salt equal to 15% by weight of the partially processed skin weight.

10. A process according to claim 1, wherein the rotation in step (j) is performed for approximately 10 minutes.

11. A process according to claim 1, wherein step (k) is carried out with an amount of formic acid which is required to obtain a pH value of the bath of 3.5, and the apparatus is rotated for 30 minutes.

12. A process according to claim 1, wherein step (l) is carried out with an amount of chromium equal to 15% by weight of the partially processed skin weight.

13. A process according to claims 1 or 12, wherein said chromium is of the self-alkalinizing type.

14. A process according to claim 1, wherein the rotation in step (m) is performed for 8 hours.

15. A process according to claim 1, wherein the rest period in step (q) is 48 hours.

16. A process according to claim 1 further comprising in sequence the steps of:

I. introducing the tanned skins to a rotable processing apparatus and blubbering the tanned skins in water at a temperature between 20° C. and 50° C. and in an amount between 0.5 and 8 times the partially processed skin weight with an amount of a blubbering agent which is between 0.5% and 10% by weight of the partially processed skin weight, and rotating the processing apparatus for a period between 10 minutes and 2 hours;

II. removing the liquid from the processing apparatus and leaving the once-blubbered skins behind;

III. introducing into the processing apparatus water at a temperature between 20° C. and 60° C. and in an amount between 0.5 and 8 times the partially processed weight of the skins, and an amount of neutralizing agent which is between 0.5% and 10% by weight of the partially processed skin weight, and rotating the processing apparatus for a period between 5 minutes and 2 hours;

IV. introducing into the processing apparatus an amount of a tannin-base vegetable origin product which is between 1% and 10% by weight of the partially processed skin weight and rotating the processing apparatus for a period between 10 minutes and 1 hour to form tannin-treated skin;

V. removing the liquid from the processing apparatus and leaving the tannin-treated skins behind;

VI. washing the tannin-treated skins with running water for a period between 5 minutes and 10 minutes and then removing the liquid;

VII. blubbering the washed skins so obtained, with water at a temperature between 20° C. and 80° C. in amounts between 1.5 and 8 times the partially processed skin weight and an amount of a softening agent which is between 1.5% and 30% by weight of the partially processed skin weight;

VIII. rotating the processing apparatus for a period between 5 minutes and 2 hours;

IX. retanning the twice-blubbered skins by means of a vegetable retanning process through the addition of an amount of tannin-base vegetable product between 2% and 50% by weight of the partially processed skin weight and rotating the processing apparatus for a period between 5 minutes and 2 hours, whereby a retanned fish skin is formed.

17. A process according to claim 16, wherein the first blubbering step is performed with water at a temperature of 35° C. and in an amount of 2 times the weight of the skins and with an amount of blubbering agent which is 2% by weight of the same weight of the skins, and the processing apparatus is rotated for 40 minutes.

18. A process according to claim 16, wherein step III is performed with water at a temperature of 40° C. and in an amount of 2 times the partially processed skin weight and with an amount of a neutralizing agent equal to 2% of the same weight, and the processing apparatus is rotated for 20 minutes.

19. A process according to claim 16, wherein step IV is performed with an amount of tannin-base vegetable origin product which is 5% by weight of the partially processed skin weight and the processing apparatus is rotated for 40 minutes.

20. A process according to claim 16, wherein step VII is performed with water at a temperature of 55° C. and in an amount of 3 times the partially processed skin weight, and with an amount of softener equal to 8% by weight the weight of the skins.

21. A process according to claims 16 or 20, wherein the rotation in step VIII is performed for 30 minutes.

22. A process according to claim 16, wherein step IX is performed with an amount of tannin-base vegetable origin product which is 13% by weight of the partially processed skin weight and the processing apparatus is rotated for 30 minutes.

23. A process as in claim 16 further comprising:

adding a dyeing agent into the processing apparatus containing the retanned fish skins;

introducing formic acid to the processing apparatus in amounts between 0.5% and 10% by weight of the partially processed skin weight and rotating the processing apparatus for a period between 10 minutes and 2 hours;

removing the liquid from the apparatus, whereby a dyed, retanned fish skin is formed.

24. A process according to claim 23, wherein the amount of formic acid is 2% by weight of the partially processed skin weight and the processing apparatus is rotated for 40 minutes.

* * * * *

UNITED STATES PATENT AND TRADEMARK OFFICE

CERTIFICATE OF CORRECTION

PATENT NO. : 4,877,410

DATED : October 31, 1989

INVENTOR(S) : Renzulli et al.

It is certified that error appears in the above-identified patent and that said Letters Patent is hereby corrected as shown below:

Column 6, line 15, "claim 2" should read --claim 1--.

Signed and Sealed this

Nineteenth Day of March, 1991

*Attest:*

HARRY F. MANBECK, JR.

*Attesting Officer*

*Commissioner of Patents and Trademarks*